United States Patent [19]

Günther et al.

[11] 4,129,412

[45] Dec. 12, 1978

[54] BRIGHTENER MIXTURES AND THEIR USE

[75] Inventors: Dieter Günther, Kelkheim; Erich Schinzel; Rüdiger Erckel, both of Hofheim am Taunus; Günter Rösch, Bad Soden am Taunus, all of Fed. Rep. of Germany

[73] Assignee: Hoechst Aktiengesellschaft, Frankfurt am Main, Fed. Rep. of Germany

[21] Appl. No.: 811,145

[22] Filed: Jun. 28, 1977

[30] Foreign Application Priority Data

Jul. 2, 1976 [DE] Fed. Rep. of Germany ..... 2629703

[51] Int. Cl.[2] ..... D06P 1/38

[52] U.S. Cl. ..... 8/1 W; 252/301.21; 252/301.24; 252/301.28; 252/301.32; 260/45.8 NZ

[58] Field of Search ..... 8/1 W, 76; 252/301.21, 252/301.32, 301.24, 301.28

[56] References Cited

U.S. PATENT DOCUMENTS 3,709,896 1/1973 Frischkorn et al. ..... 252/301.28

3,743,625 7/1973 Frischkorn et al. ..... 526/5

FOREIGN PATENT DOCUMENTS 2645301 4/1977 Fed. Rep. of Germany.
1538817 8/1968 France.
43-7045 3/1968 Japan.
44-6979 3/1969 Japan.
44-6980 3/1969 Japan.
44-6981 3/1969 Japan.
44-6982 3/1969 Japan.

OTHER PUBLICATIONS

Gold, H, "Fluorescent Brightening Agents" in Venkataraman's The Chemistry of Synthetic Dyes, vol. V, (Academic Press, 1971), pp. 536–679.

*Primary Examiner*—A. Lionel Clingman
*Attorney, Agent, or Firm*—Connolly and Hutz

[57] ABSTRACT

Mixtures of optical brighteners containing 0.05 to 1% of a 4-benzoxazolystilbene derivative and 1 to 0.05% of a 1,4-bis-benzoxazolyl- or bis-benzthiazolyl-naphthalene derivative. These mixtures show a higher degree of whiteness than an equal amount of only one of the two components.

3 Claims, No Drawings

BRIGHTENER MIXTURES AND THEIR USE

The present invention relates to brightener mixtures and their use.

The subject of the present invention are mixtures of optical brighteners containing from 0.05 to 1 part by weight of a compound of the general formula I

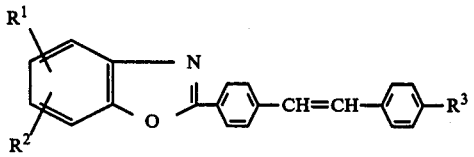

(I)

and from 1 to 0.05 part by weight of a compound of the general formula II

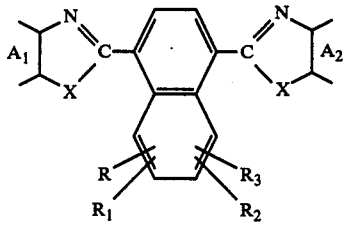

(II)

In the compound of the general formula I, the substituents $R^1$, $R^2$ and $R^3$ have the following meanings:

$R^1$ and $R^2$ may be identical or different and represent hydrogen, fluorine, chlorine, bromine, alkyl, alkoxy, dialkylamino, trialkylammonium, alkanoylamino, cyano, carboxyl, carboalkoxy, carboalkoxyalkoxy, carbophenoxy, or carbonamide, two adjacent radicals $R^1$ and $R^2$ together may also form a fused benzo ring, an alkylene or a 1,3-dioxapropylene group;

$R^3$ stands for hydrogen, cyano, a group of the formulae $COOR^4$ or $CONR_2^4$, wherein $R^4$ represents hydrogen, alkenyl, alkyl-($C_1$–$C_{18}$), cycloalkyl, aryl, alkylaryl, halogenoaryl, aralkyl, alkoxyalkyl, halogenoalkyl, hydroxyalkyl, alkylaminoalkyl, carboxyalkyl, or carboalkoxyalkyl, or two alkyl groups bound to the carbonamide group may together also form a morpholine, piperidine or piperazine ring; besides, $R^3$ may represent a group of the formula

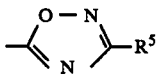

in which $R^5$ represents straight-chain or branched alkyl groups having 1 to 6 carbon atoms, which may be substituted by halogen atoms, dialkylamino, aryloxy, alkylmercapto or arylmercapto groups or aryl radicals, a phenyl, alkylphenyl or alkoxyalkyl group, a group of the formula $—(CH_2CH_2O)_n—R$, wherein R is lower alkyl and n is 2 or 3, a dialkylaminoalkoxyalkyl or alkylthioalkoxyalkyl group or those dialkylaminoalkoxyalkyl groups, in which the two alkyl groups may together form a piperidine, pyrrolidine, hexamethylene-imine, morpholine or piperazine ring.

Unless otherwise stated, the alkyl and alkoxy groups contain 1 to 4 carbon atoms, preferably 1 or 2. The cycloalkyl, aryl and aralkyl groups are preferably cyclohexyl, phenyl, naphthyl, benzyl, and phenylethyl. The carbonamide groups of the formula $CONR_2^4$ preferably contain only one radical $R^4$ which has a meaning other than hydrogen.

Among the compounds of the general formula I, preference is given to those, in which $R^1$ and $R^2$ represent hydrogen and $R^3$ stands for a group of the formula $COOR^4$ as defined above, in which $R^4$ represents in particular an alkyl group of 1 to 18 carbon atoms, preferably 1 to 4 carbon atoms.

The compounds of the general formula I — inasfar as they do not carry an oxdiazole ring — have been known from the following published Japanese Patent Application Nos.: Sho-43-7045, Sho-44-6979, Sho-44-6980, Sho-44-6981, and Sho-44-6982. The compounds with an oxdiazole ring are obtained in accordance with Swiss Patent Application No. 2918/76 by reacting 4'-benzoxyzolyl-2-stilbene-4-carboxylic acid chlorides of the formula

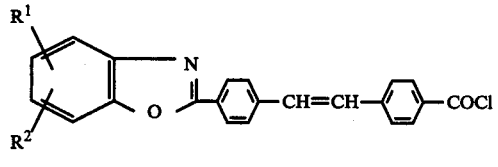

with amide oximes of the general formula

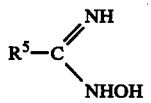

with $R^1$, $R^2$ and $R^5$ being defined as above.

In the general formula II the symbols $A_1$, $A_2$, R, $R_1$, $R_2$, $R_3$ and X have the following meanings:

$A_1$ and $A_2$ represent, independently of each other, unsubstituted or non-chromophoric substituted ring systems fused to the azole ring of benzene, naphthalene or tetrahydronaphthalene, R represents halogen, alkyl of 1 to 12 carbon atoms, alkoxy of 1 to 18 carbon atoms, alkenyl of 3 or 4 carbon atoms, cyano, cycloalkyl, phenylalkyl of 1 to 4 carbon atoms in the alkyl moiety, aralkoxy of 1 to 4 carbon atoms in the alkoxy moiety, phenyl, phenoxy, arylsulfonyl, alkylsulfonyl of 1 to 8 carbon atoms, $—SO_2NY_1Y_2$, wherein $Y_1$ and $Y_2$ — independently of each other — stand for hydrogen or optionally substituted alkyl of 1 to 8 carbon atoms, or $Y_1$ and $Y_2$ — together with the nitrogen atom to which they are bound — form a heterocyclic ring which may optionally show further hetero atoms in the ring and which may optionally be substituted, $SO_3M$, in which M stands for hydrogen or a salt-forming cation, or —COOY, wherein Y stands for hydrogen, a salt-forming cation, alkyl of 1 to 8 carbon atoms, or together with $R_1$ makes up a fused benzene ring, $R_1$ represents hydrogen, halogen, alkyl of 1 to 12 carbon atoms, alkoxy of 1 to 18 carbon atoms, alkenyl of 3 or 4 carbon atoms, or aralkoxy of 1 to 4 carbon atoms in the alkoxy moiety, or together with R makes up a fused benzene ring, $R_2$ represents hydrogen, halogen or alkyl of 1 to 12 carbon atoms, $R_3$ represents hydrogen or halogen, and X represents oxygen or =N—Z, wherein Z stands for hydrogen, alkyl of 1 to 4 carbon atoms, which may be unsubstituted or substituted by hydroxy or cyano, alkenyl of 3 or 4 carbon atoms, aralkyl of 1 to 4 carbon atoms in the alkyl moiety, or alkanoyl of 2 to 5 carbon atoms.

Preference is given to those compounds of the general formula II which correspond to the followng formula (II a)

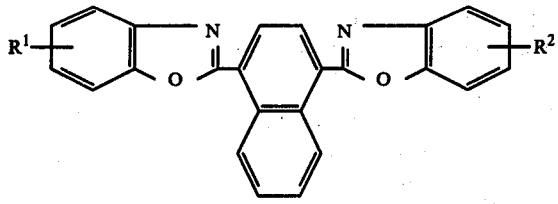

in which $R^1$ and $R^2$ may be identical or different and represent a carboxyl or a lower carbalkoxy group. The compounds of the formula II and II*a* have been known from German Offenlegungsschrift No. 2 645 301 and French Patent Specification No. 1 535 817.

The mixing ratio of the two components is between 0.05 to 1 part by weight of the compound of the formula I and also between 0.05 to 1 part by weight of the compound of formula II or II*a*. There is preferably used one part by weight of compound II or II*a* for 0.5 to 1.5 parts by weight of compound I.

As is usual in the case of optical brighteners, the individual components are brought into the commercial form by dispersion in a solvent. The individual components may be dispersed separately, and the two dispersions can then be combined. However, it is also possible to mix the two individual components in substance with each other and to disperse them jointly. This dispersion process is carried out in usual manner by way of ball mills, colloid mills, bead mills or dispersion mixers.

The mixtures of the invention are especially suitable for the brightening of textile material of linear polyesters, polyamides and acetyl cellulose. However, these mixtures may also advantageously be used for mixed fabrics which consist of linear polyesters and other synthetic or natural fibrous materials, especially fibers which contain hydroxyl groups, above all cotton. The application of these mixtures is effected under conditions that are common for the use of optical brighteners, for example according to the batchwise exhaustion method at a temperature in the range of from 90° to 130° C. with or without the addition of carriers, or according to the thermosole process. The brighteners which are insoluble in water and the mixtures of the invention may also be used while being dissolved in organic solvents, for example perchloroethylene or fluorinated hydrocarbons. In this process the textile material may be treated according to the batchwise exhaustion method with the solvent liquor containing the optical brightener in a dissolved form, or the textile goods are impregnated, sloppadded or sprayed with the brightener-containing solvent bath and are subsequently dried at a temperature in the range of from 120° to 220° C., in which process the optical brightener is completely fixed on the fiber.

Moreover, these brightener mixtures may also be used successfully for the brightening in the mass of plastic materials.

The advantage of these mixtures as compared with the individual components is to be seen in the fact that an unexpected synergetic effect is obtained with the mixtures with regard to the degree of whiteness, i.e. a mixture of the compounds of formulae I and II results in a higher degree of whiteness than the same amount of only one of the compounds of formulae I or II. The same is true for the brilliancy of the brightening. Besides, the brightening effects obtained with the brightener mixtures of the invention show a violet-bluish shade which is generally more pleasant to the human eye than the somewhat reddish brightening effects obtained when using the compounds of the formula I alone.

The following Examples illustrate the invention. The parts are parts by weight and the percentages are percent by weight. The temperature has been indicated in degrees Celsius. The degrees of whiteness were measured according to the formulae of Stensby (Soap and Chemical Specialities, April 1967, p. 41 ft) and Berger (Die Farbe, 8 (1959), pages 187 et seq.).

EXAMPLE 1

A fabric of polyester/cotton 50/50 was desized, boiled in alkali and bleached with hydrogen peroxide in common manner. The material thus prepared was subsequently impregnated with a solution which contained 0.05 g/l each of an optical brightener of the general formula (III), the formula (IV), or a mixture of the two brightening compounds (III)

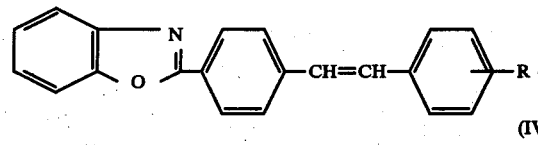

(IV)

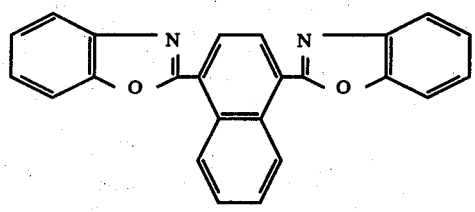

The material thus impregnated was squeezed off between rollers and was brought to a content of residual brightening solution of 80%. Subsequently it was dried on a stenter frame for 20 seconds at 120° C. and was afterwards subjected to a thermosole process for 30 seconds at 190° C. The degrees of whiteness were measured as specified in Table 1:

| R | Brightener of formula (III) % | Brightener of formula (IV) % | Degrees of whiteness Berger | Stensby |
|---|---|---|---|---|
| —COO— | 0.05 | — | 122 | 127 |
| —$COOCH_3$ | 0.05 | — | 126 | 130 |
| —$CONH_2$ | 0.05 | — | 119 | 123 |
| | — | 0.05 | 136 | 135 |
| —COO— | 0.025 | 0.025 | 136 | 137 |
| —$COOCH_3$ | 0.01 | 0.04 | 139 | 139 |
| —$CONH_2$ | 0.02 | 0.03 | 136 | 137 |

EXAMPLE 2

Polyester curtains in a raschelle tulle weave were prewashed in a continuous washing machine in common manner, were dried on the stenter frame at 120° and rolled up on a dye beam. After having been introduced into a high-temperature dyeing apparatus, the material was treated with liquors which contained 0.05% each of the brighteners of the formula III (Example 1) and V, respectively, as specified below, or a mixture of the two brightening compounds.

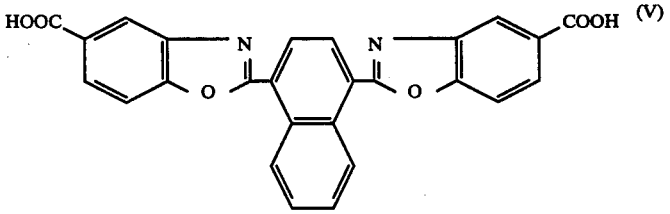

(V)

The curtain material was treated for 45 minutes at 130° C. with a goods-to-liquor ratio of 1:10, then it was rinsed in common manner at a falling temperature and dried at 120° C. The degrees of whiteness specified in Table 2 were obtained:

| R | Brightener of formula (III) % | Brightener of formula (V) % | Degrees of whiteness Berger | Degrees of whiteness Stensby |
|---|---|---|---|---|
| —COOH | 0.05 | — | 131 | 138 |
| —C(=O)—OCH$_2$CH$_2$OCH$_3$ | 0.05 | — | 131 | 137 |
| | | 0.05 | 150 | 149 |
| —COOH | 0.01 | 0.04 | 153 | 151 |
| —C(=O)—OCH$_2$CH$_2$OCH$_3$ | 0.025 | 0.025 | 150 | 151 |

The mixtures show markedly higher degrees of whiteness also upon visual inspection than the individual components.

EXAMPLE 3

A fabric of polyester filament was washed and rinsed on a jig as usual and was subsequently treated with 0.08% each of an optical brightener corresponding to the general formulae (VI) and (VII), respectively. For reasons of comparison, the brighteners were used alone and in a mixture.

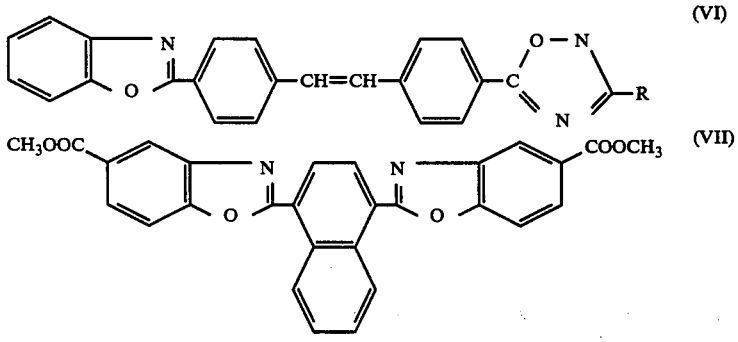

(VI)

(VII)

The polyester fabric was treated for 60 minutes at boiling temperature with a goods-to-liquor ratio of 1:6, while adding a commercial carrier on the basis of diphenyl, was then rinsed and dried at 120° C. In this process the degrees of whiteness specified in Table 3 were obtained:

| R | Brightener of formula (VI) % | Brightener of formula (VII) % | Degrees of whiteness Berger | Degrees of whiteness Stensby |
|---|---|---|---|---|
| —CH$_3$ | 0.08 | — | 145 | 147 |
| —C$_6$H$_4$—CH$_3$ | 0.08 | — | 142 | 142 |
| | 0.08 | — | 139 | 141 |
| | 0.08 | — | 145 | 148 |
| | | 0.08 | 152 | 149 |
| —CH$_3$ | 0.02 | 0.06 | 153 | 151 |
| | 0.04 | 0.04 | 154 | 151 |
| | 0.03 | 0.05 | 152 | 150 |
| | 0.01 | 0.07 | 154 | 151 |

In this Example, too, the degrees of whiteness of the mixtures were markedly higher than those obtained with the individual components.

EXAMPLE 4

Sections of knitted fabric of textured polyester filament were pre-washed and dried in common manner and were subsequently impregnated with solutions containing 0.1 g/l each of an optical brightener of the general formula (VI) and the formula (IV) respectively. For reasons of comparison, mixtures of the two brightening compounds were also used. The knitted fabric of polyester which had thus been impregnated was squeezed off between rollers to a content of residual brightening solution of 80%. Subsequently it was dried on a stenter frame for 20 seconds at 120° C. and was then subjected to a thermosole process for 40 seconds at 160° C. The following degrees of whiteness of Table 4 were obtained:

| R | Brightener of formula (VI) % | Brightener of formula (VII) % | Degrees of whiteness Berger | Stensby |
|---|---|---|---|---|
| $-CH_3$ | 0.01 | — | 130 | 128 |
| | 0.1 | — | 123 | 119 |
| 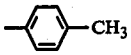 | | | | |
| | — | 0.1 | 129 | 124 |
| $-CH_3$ | 0.02 | 0.08 | 136 | 132 |
| | 0.07 | 0.03 | 133 | 131 |
| 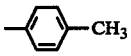 | | | | |

The mixtures of the two brightening compounds show a considerably higher degree of whiteness as compared with the same amount of the individual components.

EXAMPLE 5

A polyamide taffeta was continuously pre-washed in common manner, dried intermediately at 120° C. in the stenter frame and subsequently impregnated with dispersions containing 0.8 g/l of an optical brightener. The liquor pick-up after squeezing-off was 60%. As optical brighteners there were used products which corresponded to the formula III and the formula IV, respectively. Furthermore, mixtures according to the invention were used, as they have been specified in Table 5. Said Table contains the degrees of whiteness which were obtained after the thermosole process at the stenter frame at 190° C. during 30 seconds.

| R | Brightener of formula (III) % | Brightener of formula (IV) % | Degrees of whiteness Berger | Stensby |
|---|---|---|---|---|
| $-COOCH_3$ | 0.8 | — | 131 | 136 |
| | 0.8 | — | 115 | 120 |
| 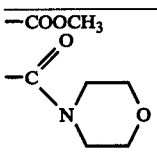 | | | | |
| | | 0.8 | 140 | 139 |
| $-COOCH_3$ | 0.4 | 0.4 | 142 | 143 |
| | 0.2 | 0.6 | 141 | 140 |
| 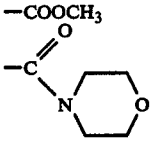 | | | | |

EXAMPLE 6

A fabric of triacetate was treated on the jig with a liquor which contained, besides 1 g/l of a detergent on the basis of nonylphenol-polyglycolether with 10 EO-groups in the molecule, 2 g/l of sodium chlorite of 50% strength and 0.08% of an optical brightener. The brightening compounds corresponded as individual products to the general formula (VI) and the formula (IV), respectively, and were used alone as well as in mixture. The goods-to-liquor ratio was 1:6. After rinsing, the material was dried at 120° C. for 30 seconds, and the degrees of whiteness were determined which have been indicated in the following Table 6.

| R | Brightener of formula (VI) % | Brightener of formula (IV) % | Degrees of whiteness Berger | Stensby |
|---|---|---|---|---|
| $-CH_3$ | 0.08 | — | 123 | 122 |
| | 0.08 | — | 105 | 105 |
| 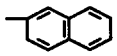 | | | | |
| | — | 0.08 | 135 | 136 |
| $-CH_3$ | 0.04 | 0.04 | 137 | 138 |
| | 0.02 | 0.06 | 138 | 138 |
| 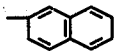 | | | | |

EXAMPLE 7

A polyester knitted fabric was impregnated with a perchloroethylene bath which contained 1 g/l of a mixture of optical brighteners consisting of 22 parts of a brightening compound of the formula (IV) and 78 parts of a brightening compound of the formula (VIII)

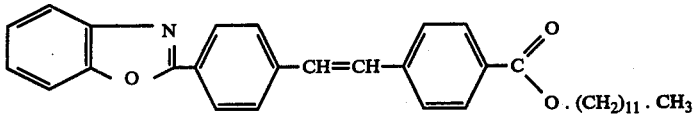

Following the impregnation, the material was squeezed off between rollers to a content of residual brightening solution of 50% and was then dried at 120° for more than 20 seconds. Subsequently it was treated for another 40 seconds at 180° C.

The textile material showed an excellent degree of whiteness which was 151 (according to Stensby), with a degree of whiteness of the gray goods of 74. As a comparison, the individual components of the mixture showed with the same concentration used and with equal application conditions a degree of whiteness of 138 and 139, respectively.

We claim:

1. Mixtures of optical brighteners containing from 0.05 to 1 part by weight of a compound of the general formula (I)

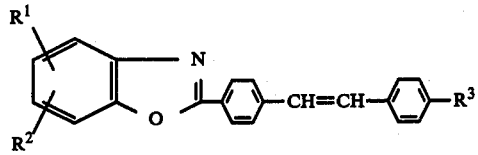

in which $R^1$ and $R^2$ may be identical or different and represent hydrogen, fluorine, chlorine, bromine, alkyl, alkoxy, dialkylamino, trialkylammonium, alkanoylamino, cyano, carboxyl, carboalkoxy, carboalkoxyalkoxy, carbophenoxy, or carbonamide, two adjacent radicals $R^1$ and $R^2$ together possibly also forming a benzo ring, an alkylene or a 1,3-dioxapropylene group, and $R^3$ stands for hydrogen, cyano, a group of the formulae $COOR^4$ or $CONR_2^4$, wherein $R^4$ represents hydrogen, alkenyl, alkyl($C_1$–$C_{18}$), cycloalkyl, aryl, alkylaryl, halogenoaryl, aralkyl, alkoxyalkyl, halogenoalkyl, hydroxyalkyl, alkylaminoalkyl, carboxyalkyl, or carboalkoxyalkyl, or two alkyl groups bound to the carbonamide group may together also form a morpholine, piperidine or piperazine ring, or $R^3$ represents a group of the formula

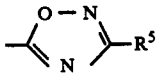

in which $R^5$ represents straight-chain or branched alkyl groups having 1 to 6 carbon atoms, which may be substituted by halogen atoms, dialkylamino, aryloxy, alkylmercapto or arylmercapto groups or aryl radicals, a phenyl, alkylphenyl or alkoxyalkyl group, a group of the formula $—(CH_2CH_2O)_n—R$, wherein R equals lower alkyl and n is 2 or 3, a dialkylaminoalkoxyalkyl or alkylthioalkoxyalkyl group or those dialkylaminoalkoxyalkyl groups in which the two alkyl groups may together form a piperidine, pyrrolidine, hexamethylene-imine, morpholine or piperazine ring, and from 1 to 0.05 part by weight of a compound of the general formula

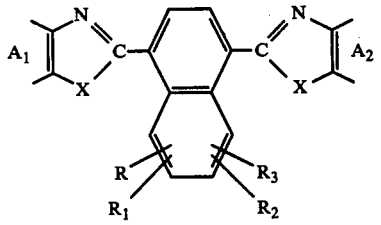

in which $A_1$ and $A_2$ represent, independently of each other, unsubstituted or non-chromophoric substituted ring systems fused to the azole ring of benzene, naphthalene or tetrahydronaphthalene, R represents halogen, alkyl of 1 to 12 carbon atoms, alkoxy of 1 to 18 carbon atoms, alkenyl of 3 or 4 carbon atoms, cyano, cycloalkyl, phenylalkyl of 1 to 4 carbon atoms in the alkyl moiety, aralkoxy of 1 to 4 carbon atoms in the alkoxy moiety, phenyl, phenoxy, arylsulfonyl, alkylsulfonyl of 1 to 8 carbon atoms, $—SO_2NY_1Y_2$, wherein $Y_1$ and $Y_2$ — independently of each other — stand for hydrogen or optionally substituted alkyl of 1 to 8 carbon atoms, or $Y_1$ and $Y_2$ — together with the nitrogen atom to which they are bound — form a heterocyclic ring which may optionally show further hetero atoms in the ring and which may optionally be substituted, $SO_3M$, in which M stands for hydrogen or a salt-forming cation, or —COOY, wherein Y stands for hydrogen, a salt-forming cation, alkyl of 1 to 8 carbon atoms, or together with $R_1$ makes up a fused benzene ring, $R_1$ represents hydrogen, halogen, alkyl of 1 to 12 carbon atoms, alkoxy of 1 to 18 carbon atoms, alkenyl of 3 or 4 carbon atoms or aralkoxy of 1 to 4 carbon atoms in the alkoxy moiety, or together with R makes up a fused benzene ring, $R_2$ represents hydrogen, halogen or alkyl of 1 to 12 carbon atoms, $R_3$ represents hydrogen or halogen, and X represents oxygen or =N—Z, wherein Z stands for hydrogen, alkyl of 1 to 4 carbon atoms, which may be unsubstituted or substituted by hydroxy or cyano, alkenyl of 3 or 4 carbon atoms, aralkyl of 1 to 4 carbon atoms in the alkyl moiety, or alkanoyl of 2 to 5 carbon atoms.

2. Mixtures as claimed in claim 1, which contain those compounds of the general formula I, wherein $R^1$ and $R^2$ represent hydrogen and $R^3$ stands for a group of the formula —COO—($C_1$–$C_4$)alkyl.

3. Mixtures as claimed in claim 1, which contain those compounds of the general formula II, wherein $A_1$ and $A_2$ represent phenyl rings substituted by carboxyl or ($C_1$–$C_4$)carboalkoxy groups, X stands for oxygen and R, $R_1$, $R_2$ and $R_3$ represent hydrogen.

* * * * *